United States Patent [19]

Rademacher

[11] 4,406,628

[45] Sep. 27, 1983

[54] TRAINING DEVICE FOR SWIMMERS

[75] Inventor: Thomas P. Rademacher, Medina, Ohio

[73] Assignee: McNeil Corporation, Akron, Ohio

[21] Appl. No.: 269,989

[22] Filed: Jun. 3, 1981

[51] Int. Cl.[3] ..... A63B 31/00

[52] U.S. Cl. ..... 434/254; 272/1 B; 428/178; 441/129

[58] Field of Search ..... 434/254; 272/71, 1 B; D21/236, 237; 441/129; 52/795, 799, 801; 428/178

[56] References Cited

U.S. PATENT DOCUMENTS

| | | | |
|---|---|---|---|
| D. 187,677 | 4/1960 | Hollington | 272/1 B X |
| D. 203,365 | 12/1965 | Heston | D21/237 X |
| 2,931,648 | 4/1960 | Davies | 272/1 B |
| 3,011,602 | 12/1961 | Ensrud | 428/178 X |

*Primary Examiner*—Harland S. Skogquist

*Attorney, Agent, or Firm*—Hamilton, Renner & Kenner

[57] ABSTRACT

A kickboard for supplementing the buoyancy of a swimmer when grasped by a swimmer's hands including a generally elongate rectangular member (11) of relatively lesser thickness, one side (20) of said member being a generally planar surface, the other side (30) of said member having a plurality of spaced depressions (35) having wall sections (36, 37) thereof extending a substantial portion of the thickness of said member for providing substantial structural rigidity, some of said depressions having a portion (38) thereof attached to said one side (20) of said member for enhancing the strength and rigidity of said member and some of said depressions being positioned proximate the periphery of said member to facilitate gripping by a swimmer's hands.

9 Claims, 4 Drawing Figures

10
11
12
13
14
15
16
17
20
21
22
30
35
35'
38
39
45
46
47
48
50

17
16
15
3
17
16
16
11
17
10
17
38
16
16
22
22
20
21
13
38
4
4
12
48
50
46
47
48
38
22
14
3

TRAINING DEVICE FOR SWIMMERS

TECHNICAL FIELD

The present invention relates generally to a buoyant device for use by swimmers. More particularly, the present invention relates to a device for providing flotation for a portion of a swimmer's body in the development of swimming techniques. More specifically, the present invention relates to a type of kickboard for providing supplemental flotation for a swimmer's arms, head and upper torso as during the development of leg kicking techniques and related strength and endurance.

BACKGROUND ART

With the increasing popularity of competitive swimming and the attendant emphasis upon sophisticated training procedures and training equipment, there has been a vast increase in the appearance of different devices for use in competitive and recreational swimming development. One area which has seen a proliferation of activity is in regard to flotation devices which are employed to effect or supplement flotation and provide total or partial immobilization of a portion or portions of a swimmer's body in order to concentrate on the development of techniques involving other body portions involved in the makeup of a swimming stroke. Well known examples of devices of this nature are kickboards, leg buoys and water wings, all of which have appeared in the swimming training aid field in a variety of forms.

In regard particularly to kickboards, such devices are employed to provide flotation for an essential immobilization of a swimmer's arms while permitting the development of improved techniques or strength and endurance with respect to leg motions and/or breathing techniques. Kickboards of various types have been developed primarily of inflated or foam materials which, within reasonable size constraints, produce significant buoyancy assistance to maintain the arms, and if desired, the head of a swimmer in a generally prone position at or above the water surface. In most instances, kickboards have been constructed of a single uniform thickness of foam material defined on the top and bottom by planar surfaces. Various sizes of kickboards have been evolved for different purposes requiring differing amounts of buoyant force. These prior art kickboards are commonly provided with a curved, tapered or rounded extremity to at least give an appearance of a front or forward end thereof that in some instances may be employed to facilitate gripping.

To applicant's knowledge existing devices have been somewhat deficient in that the buoyant effect of a single kickboard cannot be varied to optimally accommodate swimmers of differing sizes and weights. In addition existing kickboards generally have no manner by which fluidic drag can be varied to enable a swimmer to establish varying resistance characteristics for differing purposes, inasmuch as the flat surfaces of kickboards are generally planar and have uniform drag parameters dependent solely upon the surface material and characteristics. Further, many of the kickboards of which applicant is aware are somewhat slippery or difficult to grasp when wet. Further, many of the kickboard devices which have been developed to date are not constructed in a fashion to withstand the rigors of both proper and occasionally improper usage to which they are inevitably subjected in the recreational environment of swimming pools.

DISCLOSURE OF THE INVENTION

Therefore an object of the present invention is to provide a kickboard which is effective in supplying supplemental buoyancy for the arms, head and/or upper torso of a swimmer in order to develop leg kicking and breathing techniques and/or related strength and endurance. Another object of the present invention is to provide a kickboard which can be readily manipulated by a swimmer in order to vary the buoyant effects or to accommodate swimmers of different sizes and weights. A further object of the invention is to provide a single kickboard which carries out the functions of a plurality of different sizes of kickboards of conventional design. Still another object of the invention is to provide a kickboard wherein the drag characteristics may be selectively varied by a swimmer by adjusting the orientation of the kickboard relative to the surface of the water. Yet another object of the invention is to provide a thin-walled plastic kickboard which resists bending and crushing forces attendant to a swimming pool training device and a recreational environment generally. A still further object of the invention is to provide such a kickboard which will deflect to a sufficient degree such that it will not inadvertently injure a person who runs into or is struck by the kickboard. Another object of the invention is to provide such a kickboard by incorporating a sufficient number of depressions having vertical walls and curved junctures such that adequate structural rigidity is inherent.

Yet a further object of the invention is to provide a hollow kickboard wherein depressions in at least one of the sides of the kickboard are joined to portions of the other side of the kickboard or depressions therein such that relative movement between the thin walls of the two sides is precluded, thus providing such a device having improved structural stability.

Still another object of the invention is to provide a kickboard wherein one or both sides are provided with strategically placed depressions to facilitate gripping by a swimmer's hands even in water. Still another object of the invention is to provide a kickboard which exhibits differing drag and buoyancy characteristics depending upon which side is placed in contact with the water and in the case of one side, the extent to which the side is normally in engagement with the water as controlled by the angle of inclination thereto selected by a swimmer.

Yet a further object of the invention is to provide a device which is constructed of a minimal amount of material in a manner which may be accomplished by existing production techniques. A final object of the invention is to provide a kickboard which is versatile in use, resists environmental conditions and is otherwise well adapted for its intended purpose.

In general, the device according to the invention for supplementing the buoyancy of a swimmer when grasped by a swimmer's hands, includes a generally elongate rectangular member of relatively lesser thickness, one side of said member being a generally planar surface, the other side of said member having a plurality of spaced depressions having wall sections thereof extending a substantial portion of the thickness of said member for providing substantial structural rigidity, some of said depressions having a portion thereof attached to said one side of said member for enhancing the strength and rigidity of said member and some of said depressions being positioned proximate the periphery of said member to facilitate gripping by a swimmer's hands.

PREFERRED EMBODIMENT FOR CARRYING OUT THE INVENTION

Figure 1:
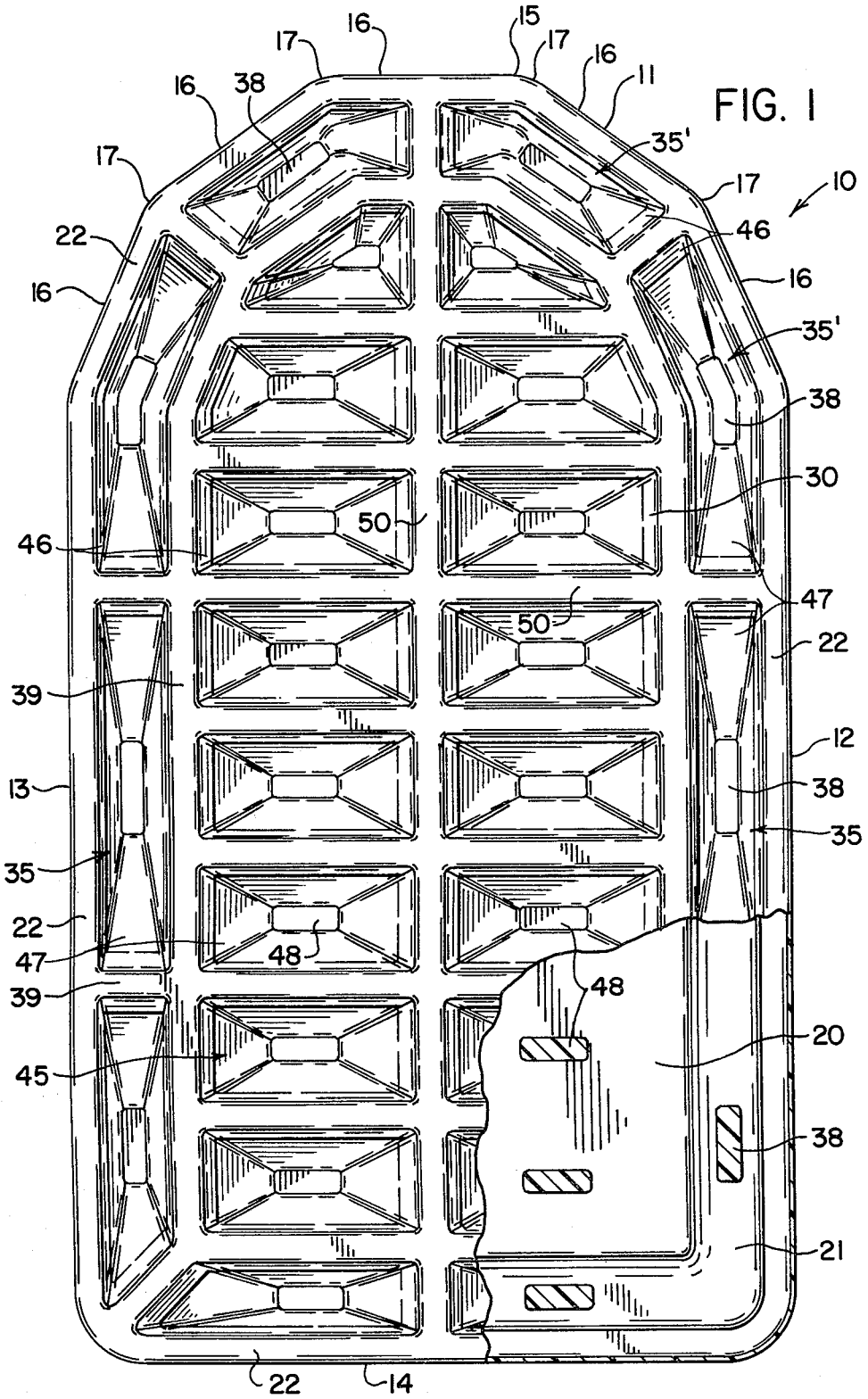
FIG. 1 is a top plan view of a kickboard embodying the concept of the present invention with a portion broken away to depict certain of the internal structure.
Figure 2:
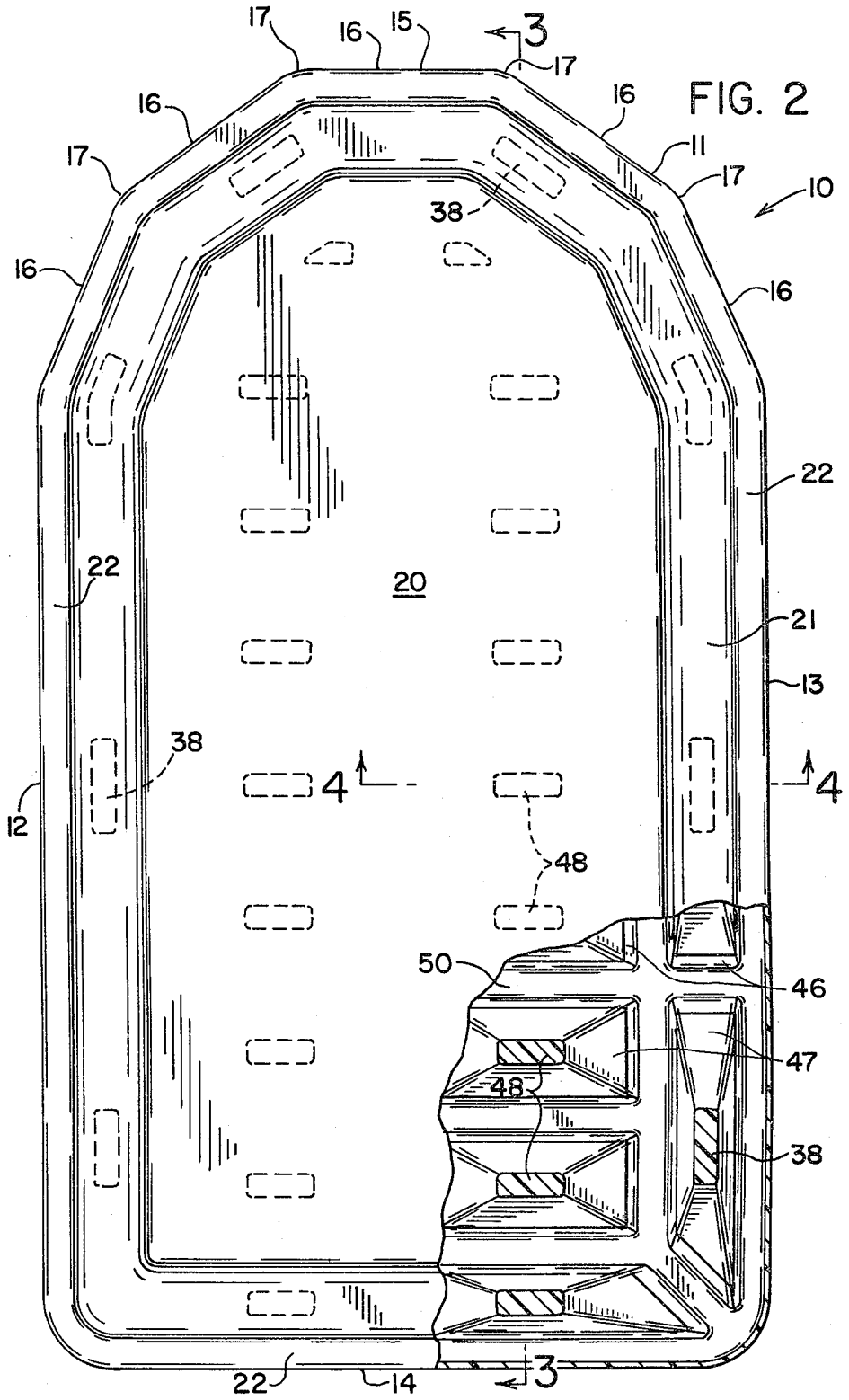
FIG. 2 is a bottom plan view of the kickboard of FIG. 1 with a portion similarly broken away to depict certain of the internal structure.

A kickboard according to the concepts of the present invention is generally indicated by the numeral 10 in FIGS. 1 and 2 of the drawings. As shown, the kickboard 10 is preferably a unitary body 11 which as seen in the cross sectional depictions of FIGS. 3 and 4 of the drawings may be of relatively thin-walled construction. The unitary body 11 may be formed of polypropylene or other suitable plastics, as will be appreciated by persons skilled in the plastics molding art, compounded to have substantial rigidity for a limited thickness of material, e.g., on the order of six-hundredths (0.06) of an inch, while permitting an extent of deflection at least in a localized area upon impact.

As seen in FIGS. 1 and 2, the unitary plastic body 11 is of a generally rectangular configuration having elongate lateral edges 12 and 13 which may conveniently be parallel or substantially parallel. A linear edge 14 at one longitudinal extremity spaces and joins the lateral edges 12, 13 and is of lesser extent. The kickboard 10 has at the other longitudinal extremity a generally curved edge 15 similarly spacing and joining the lateral edges 12 and 13. The curved edge 15 is preferably composed of a plurality of linear elements 16 which are interconnected by relatively short curvilinear elements 17. The combination of linear elements 16 and curvilinear elements 17 facilitates, in the event that the kickboard 10 is to be held by a swimmer proximate what is preferably the forward extremity thereof when positioned in the water for training purposes, maintaining a secure grasp of a wet object with a minimum of effort.

Figure 3:
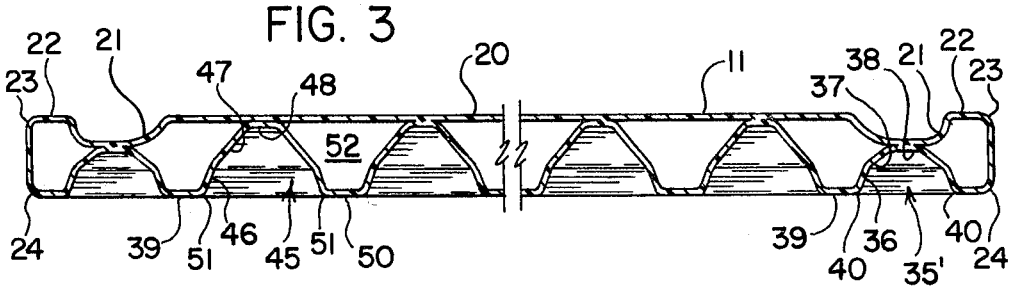
FIG. 3 is a fragmentary sectional view taken substantially along the line 3—3 of FIG. 2 showing an exemplary portion of the cross section configuration of the kickboard longitudinally thereof.
Figure 4:
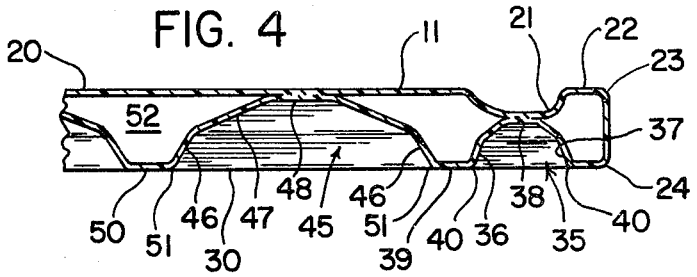
FIG. 4 is a fragmentary cross sectional view taken substantially along the line 4—4 of FIG. 2 and depicting a portion of the cross sectional construction laterally thereof.

As best seen in FIGS. 2, 3 and 4, one side of the kickboard 10 is a substantially planar surface 20. The planar surface 20 is continuous both laterally and longitudinally of integral body 11 on the one side to a position preferably proximate to but spaced from the peripheral edges of the body 11 on all sides thereof. The surface 20 has adjacent the edges of the body 11 a circumferential slot 21 which may be of generally hemispheric cross sectional configuration as seen particularly in FIGS. 3 and 4 of the drawings. The slot 21 has formed outwardly thereof defining the various edges 12, 13, 14 and 15 a generally rectangular enclosed rim 22. The rim 22 as seen in FIGS. 1 and 2 extends about the entire periphery of the integral body 11 and preferably has outwardly thereof rounded corners 23 and 24 (see FIGS. 3 and 4) for increased strength and rigidity and to obviate the possible dangers sharp edges would present to a swimmer.

The side of the kickboard 10 opposite the continuous planar surface 20 is an irregular surface 30 as best seen in FIG. 1 of the drawings. The irregular surface 30 includes a plurality of peripheral depressions, generally indicated by the numeral 35, which are preferably generally continuous about the body 11 inwardly of the rim 22 and of generally rectangular configuration in the areas along the edges 12, 13 and 14. The peripheral depressions 35', in the area of curved edge 15 may be angled or offset to follow the contours of the linear elements 16 and curvilinear elements 17. While thus configured to some extent in a manner defined by the configuration of the edges, the peripheral depressions 35,35' are generally similarly configured in numerous respects. In particular each of the peripheral depressions 35 consists of a first truncated pyramidal wall section 36 which is joined to a second truncated pyramidal wall section 37 as best seen in FIGS. 1, 3 and 4 of the drawings. One planar boundary of the pyramidal section 37 is a flat wall 38 which is attached to or preferably integrally formed with a portion of the circumferential slot 21 and specifically a portion of the lower extremity thereof. The depressions 35 are bounded by peripheral ribs 39 except on sides adjacent the rim 22. The truncated peripheral sections 36 merge with the rim 22 or with adjacent peripheral ribs 39 in beveled corners 40 of preferably small radius.

By thus attaching or integrally forming a portion of the planar surface 20 and irregular surface 30 separation or relative lateral motion between the surfaces of the kickboard 10 is eliminated or at least severely restricted. It is to be appreciated that each of the peripheral depressions is both similarly configured and similarly attached or integrally formed with the adjacent portion of the slot 21 of planar surface 20. It is thus to be seen that the surfaces 20 and 30 are peripherally connected internally of the rim 22 at spaced portions about the periphery of the kickboard 10. The interconnection between the peripheral depressions 35 and the slot 21 is such that while imparting increased rigidity between the surface 20 and 30 such also provides a continuous slot on one surface with intermittent depressions on a second, aligned surface for purposes of providing areas of variable thickness facilitating grasping by the thumb and fingers of a swimmer. In addition, depressions 35, rim 22 and slot 21 or the entire unitary body 11 may be randomly embossed or provided with other than a smooth surface to provide enhanced gripping friction.

The portion of irregular surface 30 disposed inwardly of the peripheral depressions 35 is preferably provided with a pattern of additional depressions for purposes of providing increased strength and rigidity medially of the kickboard and for supplementing the bond between surfaces 20 and 30. As shown particularly in FIG. 1, the cut-away portion of FIG. 2 and the corresponding portions of FIGS. 3 and 4 the medial portions of surface 30 is provided with a plurality of internal depressions 45 which may assume, as seen in the preferred embodiment, a substantial portion of the surface 30. The internal depressions 45 are preferably constructed comparable to the depressions 35 in that they have a first truncated pyramidal section 46 which is joined to a second truncated pyramidal section 47 as seen particularly in FIGS. 3 and 4 of the drawings. One planar boundary of the pyramidal section 47 is a flat wall 48 which is attached to or preferably integrally formed with a portion of the planar surface 20 internally of the circumferential slot 21.

In a manner similar to the peripheral depressions 35, depressions 45 are bounded by the ribs 39 or internal ribs 50 extending longitudinally and laterally of the surface 30. The depressions 45 are joined to the peripheral ribs 39 and the internal ribs 50 by beveled corners 51 best seen in FIGS. 3 and 4 of the drawings, thereby forming interstices 52 between the depressions 45.

From the above description it will be readily apparent to persons skilled in the art that a wide variety of configurations of the depression 45 and the webs 50 could be provided while achieving the objects of the present invention. In particular the webs could be of greater of lesser width and the dimensions of the depressions 45 could be varied while carrying out the objects of increasing the strength and rigidity of the structure and supporting the bond between the surfaces 20, 30 thereof. Further, while the depressions 35 have their longitudinal dimension paralleling the peripheral boundary of the body 11 and the longitudinal dimension of depressions 45 positioned laterally thereof, other arrangements are possible as a matter of design. It is also to be appreciated that the configuration of certain of the depressions 45 may be altered in one or a plurality of dimensions to effect conformance with the available area proximate the curved surface 15 of the kickboard 10. Also, the depressions 35, 45 could well be formed with conical, spherical or other curved walls or combinations thereof while carrying out the concepts of the present invention.

Whatever the dimensions and layout of depressions 35, 35', and 45 such are preferably constructed and arranged in a fashion as to provide a substantial number of individual compartments in the surface 30. In this manner when the kickboard 10 is positioned flush on the water with the surface 30 facing down, air is entrapped in the depressions 35, 45 to provide substantial supplemental buoyancy in addition to the significant amount of air entrapped at all times between the surfaces 30 and 40, primarily in the rim 22 and interstices 52. It is to be appreciated in this respect that the supplemental buoyancy force provided by the depressions 35, 45 may be varied by a swimmer by inclining the kickboard 10 with respect to the water surface such that air is released from a selected portion of the depressions 35 and 45 to thus reduce the overall buoyant effect produced by kickboard 10. If it is desired that kickboard 10 provide minimum buoyant assistance it may be positioned in the water with the surface 20 facing downwardly such that by the continuous extent of slot 21 there is no supplemental entrapment of air.

It is also to be appreciated that in addition to the variable buoyancy potential when kickboard 10 is positioned with surface 30 in engagement with the water such orientation can also be employed as a vehicle to effect the drag characteristics of the kickboard 10. In particular, in a flush position on water the kickboard 10 provides minimal drag in relation to the existing drag of a swimmer's body. If the forward portion of curved surface 15 of kickboard 10 is displaced upwardly with respect to the water, wall portions of the depressions 35 and 45 assume a position substantially perpendicular to the water surface such that upon movement of kickboard 10 through the water with a swimmer, increased drag is provided by the kickboard depending upon these various parameters. The extent of the variation in drag may be controlled by a swimmer merely by varying the angle of inclination of the kickboard with respect to the water surface.

Thus it should be evident that the kickboard described herein carries out the various objects of the invention set forth hereinabove and otherwise constitutes an advantageous contribution to the art. As may be apparent to persons skilled in the art, modifications can be made to the preferred embodiment disclosed herein, as suggested in some instances above, and otherwise without departing from the spirit of the invention, the scope of the invention being defined solely by the scope of the attached claims.

I claim:

1. A device for supplementing the buoyancy of a swimmer when grasped by a swimmer's hands comprising, a generally elongate rectangular member of relatively lesser thickness, one side of said member being generally planar, the other side of said member having a plurality of spaced depressions having a portion of the walls thereof extending a substantial portion of the thickness of said member for providing substantial structural rigidity, some of said depressions having a portion thereof attached to said one side of said member for enhancing the strength and rigidity of said member and some of said depressions being positioned proximate the periphery of said member, said one side of said member having a slot positioned in reverse proximity to and attached to said depressions being positioned proximate the periphery of said member, thereby facilitating gripping by a swimmer's hands.

2. A device according to claim 1 wherein said depressions are disposed substantially uniformly throughout said other side of said member, whereby air may be selectively entrapped to provide supplemental buoyancy.

3. A device according to claim 2 wherein said depressions are separated by ribs forming interstices positioned between said depressions.

4. A device according to claim 1 wherein the longitudinal dimension of said depressions positioned proximate the periphery of said member parallels the peripheral boundary thereof.

5. A device according to claim 4 wherein additional depressions are positioned inwardly of said depressions positioned proximate the periphery of said member.

6. A device according to claim 5 wherein the longitudinal dimension of said depressions positioned internally of said depressions positioned proximate the periphery of said member have the longitudinal dimension thereof extending transversely of said member.

7. A device according to claim 1 wherein said slot is proximate to and extends continuously about the periphery of said member.

8. A device according to claim 1 having a longitudinal extremity of generally curved configuration including a plurality of linear elements interconnected by curved elements.

9. A device according to claim 1 wherein the entire surface of said member is randomly embossed.

* * * * *